United States Patent [19]

Mullins et al.

[11] Patent Number: 4,647,314

[45] Date of Patent: Mar. 3, 1987

[54] RINSE WATER ADDITIVE

[75] Inventors: Michael A. Mullins, Wayne; Peter A. Thomas, Budd Lake, both of N.J.

[73] Assignee: Drew Chemical Corporation, Boonton, N.J.

[21] Appl. No.: 708,572

[22] Filed: Mar. 5, 1985

[51] Int. Cl.[4] ..... B08B 3/08; B08B 7/04; C11D 1/62; C11D 1/835

[52] U.S. Cl. ..... 134/30; 134/25.1; 134/25.4; 134/26; 252/174.21; 252/547; 252/DIG. 1; 252/41

[58] Field of Search ..... 252/174.21, 174.22, 252/547, DIG. 1; 134/25.3, 25.4, 26, 30, 25.1

[56] References Cited

U.S. PATENT DOCUMENTS

| | | | |
|---|---|---|---|
| 3,272,899 | 9/1966 | Diamond | 264/126 |
| 3,340,309 | 9/1967 | Weipert | 252/174.22 |
| 3,563,901 | 2/1971 | Crotty | 252/136 |
| 3,983,079 | 9/1976 | Spadini | 252/545 |
| 4,443,363 | 4/1984 | Klinger | 252/547 |

FOREIGN PATENT DOCUMENTS

| | | | |
|---|---|---|---|
| 662710 | 10/1965 | Belgium | 252/547 |
| 0077588 | 4/1983 | European Pat. Off. | 252/547 |

OTHER PUBLICATIONS

Technical Data on Pluronic Surfactants as Rinse Aids, Bulletin, No. F 3305, published by Wyandotte Chemicals Co., Wyandotte, Mich., 4 pages.

*Primary Examiner*—Dennis L. Albrecht
*Attorney, Agent, or Firm*—Elliot M. Olstein

[57] ABSTRACT

Can containing food are rinsed with an aqueous solution of quaternary ammonium salt and oxyalkylene polymer (homopolymer of oxyethylene or copolymer of oxyethylene and oxypropylene).

4 Claims, No Drawings

RINSE WATER ADDITIVE

This invention relates to a rinse water additive, and more particularly to the rinsing of materials. Most particularly, this invention relates to the rinsing of metal food cans.

The appearance of cans containing food is of utmost importance in that the consuming public will ordinarily reject a stained or spotted can. In producing food in cans, in many processes, the food in the cans is subjected to a steaming process, and subsequent to such steaming process, it is necessary to rinse the cans with water so as to provide a food can which is free of staining or spotting. As hereinabove indicated, the ability to effectively rinse such cans so as to prevent stained or spotted food cans is an important step in the overall process, and as a result, there is a need for improved rinsing compositions so as to prevent such staining or spotting of cans.

In accordance with one aspect of the present invention, there is provided an improved rinse solution of water containing an effective rinsing amount of a water soluble quaternary ammonium salt, and a water soluble oxyalkylene polymer. Such a rinse solution is particularly effective for rinsing metal cans containing food so as to prevent staining or spotting of the cans. The rinsing is particularly applicable to the processing of food in cans wherein the rinsing is effected after the food in the cans is subjected to treatment with steam.

The term "water soluble", as used herein, means that the component is soluble in water to an extent so as to render it effective for rinsing purposes.

The water soluble oxyalkylene polymer which is employed for rinsing in accordance with the present invention is either a homopolymer of oxyethylene or a copolymer of oxyethylene and oxypropylene. The copolymer may be either a random copolymer or a block copolymer, preferably a random copolymer.

The oxyalkylene polymer may be employed in the form of a glycol or in a form wherein one or both of the terminal hydrogen atoms has been replaced with an organic residue which does not render the polymer water insoluble; in particular, the residue of a hydrocarbon alcohol including a phenol or alkyl substituted phenol, a hydrocarbon carboxylic acid, a hydrocarbon amine, or a hydrocarbon amide. The preferred oxyalkylene polymers have one or both hydroxy groups replaced with an organic residue.

The oxyalkylene polymer has a molecular weight which is effective for providing the desired rinsing. In general, when the oxyalkylene polymer is an oxyethylene homopolymer, the molecular weight is at least about 500, and generally does not exceed about 6000. In most cases, the molecular weight does not exceed about 4000.

In the case where the oxyalkylene polymer is a copolymer of oxyethylene and oxypropylene, the molecular weight of the copolymer is at least about 1000 and generally does not exceed about 10,000. In most cases, the molecular weight does not exceed 5000.

In employing a copolymer of oxyethylene and oxypropylene, in general, the oxyethylene content is from about 30% to about 99% by weight, and preferably from about 40% to about 60% by weight.

The second component of the aqueous rinse solution is a water soluble quaternary ammonium salt. Such quaternary ammonium salt may be represented by the following structural formula:

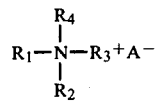

wherein each of $R_1$, $R_2$, $R_3$ and $R_4$ is preferably a hydrocarbon radical, which may be either an aromatic hydrocarbon or an aliphatic hydrocarbon, most preferably an aliphatic hydrocarbon, with such aliphatic hydrocarbon generally being a branched or straight chain alkyl group. $R_1$, $R_2$, $R_3$ and $R_4$ may be the same or different radicals, and R may have from 1–18 carbon atoms. In a preferred embodiment two of the R groups have 1–2 carbon atoms and the remaining two R groups have from 7–18 carbon atoms. A is an appropriate anion, such as a halide, methosulfate and is preferably a chloride ion. A preferred compound is dioctyl dimethyl ammonium chloride.

The rinse water contains an effective rinsing amount of the quaternary ammonium salt and the oxyalkylene polymer. In general, the combination of oxyalkylene polymer and quaternary ammonium salt is present in the rinse water in an amount of at least 1.0 ppm, and preferably at least 3.0 ppm. In most cases, the active ingredients are not present in an amount in excess of 100 ppm; however, it is to be understood that greater amounts could be employed, but in most cases there is no beneficial result from using such greater amounts.

In the rinse water, the ratio of oxyalkylene polymer to quaternary ammonium salt, by weight, is generally from 1:25 to 25:1 and preferably from 1:1 to 5:1. In rinsing metal cans, the composition should include the hereinabove described ratios in order to insure that there is sufficient cationic present for effective rinsing.

In a preferred embodiment, the rinsing composition may be initially formulated as an aqueous solution of the quaternary ammonium salt and the oxyalkylene polymer, and such aqueous solution may then be added to the rinse water to provide the desired concentration of active ingredients in the rinse water. In preparing an aqueous solution of the quaternary ammonium salt and oxyalkylene polymer for later addition to rinse water, in general, the active ingredients are present in such a composition in an amount of at least 1.0 wt. % and generally in an amount no greater than 25 wt. %, based on 100 parts by wt. of the aqueous composition. The ratio of oxyalkylene polymer to quaternary ammonium salt in such an aqueous composition may be as hereinabove described.

The rinse composition may include other components, such as dyes, fragrances, etc., provided that such components do not adversely affect the rinse components.

The rinsing composition has a particular use for rinsing of metal cans containing food, with the rinse solution preferably being employed, as hereinabove described, subsequent to treating the cans containing food with steam.

In the rinsing operation, the rinse water is generally at a temperature in the order of from 50° F. to 150° F., and the rinsing composition of the present invention is effective in rinse water applied to food cans at such temperatures. It is to be understood, however, that the rinsing composition may also be employed in rinse waters at other temperatures.

The invention will be further described with respect to the following examples; however, the scope of the invention is not to be limited thereby:

EXAMPLE

The following rinse composition is prepared:

| Composition A | | |
|---|---|---|
| (1) | Dioctyl dimethyl ammonium chloride. | 2.5% |
| (2) | Random copolymer of 50:50 oxyethylene and oxypropylene having one end terminated with a butoxy group (M.W. 4000). | 10.0% |
| (3) | Demineralized water | 87.5% |

The above composition is tested as a rinse aid in water.

Steel panels are inserted into the water at 75° F., and rinse time is visually observed after withdrawal.

| | | Rinse Time (Secs) |
|---|---|---|
| Boonton City Water + Composition A | (0 ppm) | 60 |
| | (25 ppm) | 30 |
| | (50 ppm) | 30 |
| | (100 ppm) | 20 |
| Standard Hard Water + Composition A | (0 ppm) | 60 |
| | (25 ppm) | 25 |
| | (50 ppm) | 25 |
| | (100 ppm) | 20 |

Numerous modifications and variations of the present invention are possible in light of the above teachings and, therefore, within the scope of the present claims, the invention may be practiced otherwise than as particularly described.

What is claimed is:

1. A process for rinsing cans containing food after steaming of the cans, comprising:

rinsing the cans with water containing an effective rinsing amount of a water soluble quaternary ammonium salt and a water soluble oxyalkylene polymer selected from the group consisting of oxyethylenehomopolymers having a molecular weight of at least 500 and not in excess of 6,000, and copolymers of oxyethylene and oxypropylene wherein the oxyethylene content is from 50% to 99% by weight, and the molecular weight is at least 1,000 and does not exceed 10,000, with the weight ratio of oxyalkylene polymer to quaternary ammonium salt being from 1:25 to 25:1, and said quaternary ammonium salt having the following structural formula:

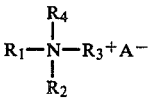

wherein each $R_1$, $R_2$ (and) $R_3$ and $R_4$ is a hydrocarbon radical having from 1–18 carbon atoms and at least two of $R_1$, $R_2$, $R_3$ and $R_4$ contain at least 7 carbon atoms and A is an anion.

2. The process of claim 1 wherein the oxyethylene content of the copolymer is from 40% to 60% by weight.

3. The process of claim 2 wherein two of the groups represented by $R_1$–$R_4$ have 1–2 carbon atom, and the remaining two groups represented by $R_1$–$R_4$ have from 7–18 carbon atoms.

4. The process of claim 3 wherein the weight ratio of oxyalkylene polymer to quaternary ammonium salt is from 1:1 to 5:1.

* * * * *